United States Patent [19]

Yates et al.

[11] 4,277,038

[45] Jul. 7, 1981

[54] TRAJECTORY SHAPING OF ANTI-ARMOR MISSILES VIA TRI-MODE GUIDANCE

[75] Inventors: Robert E. Yates; John P. Leonard; Robert E. Alongi; Wilfredo V. Albanes; Charles M. Bishop, all of Huntsville, Ala.

[73] Assignee: The United States of America as represented by the Secretary of the Army, Washington, D.C.

[21] Appl. No.: 34,088

[22] Filed: Apr. 27, 1979

[51] Int. Cl.[3] ..... F42B 15/02

[52] U.S. Cl. ..... 244/3.15

[58] Field of Search ..... 244/3.15, 3.16, 76 R, 244/175, 181

[56] References Cited

U.S. PATENT DOCUMENTS

| | | | |
|---|---|---|---|
| 2,821,349 | 1/1958 | Sohn | 244/3.15 |
| 2,951,658 | 9/1960 | Jones, Jr. et al. | 244/3.16 |
| 3,088,034 | 4/1963 | Jones, Jr. et al. | 244/3.16 |
| 3,097,816 | 7/1963 | Berry | 244/3.15 |
| 3,695,555 | 10/1972 | Chadwick | 244/3.16 |
| 3,718,293 | 2/1973 | Willems et al. | 244/3.16 |
| 3,743,215 | 7/1973 | Harris | 244/3.14 |
| 4,033,525 | 7/1977 | Leonard et al. | 244/3.15 |
| 4,123,019 | 10/1978 | Amberntson | 244/3.16 |
| 4,198,015 | 4/1980 | Yates et al. | 244/3.15 |

*Primary Examiner*—Charles T. Jordan

*Attorney, Agent, or Firm*—Nathan Edelberg; Robert P. Gibson; Freddie M. Bush

[57] ABSTRACT

In a missile system, a simple way to guide a missile in a predetermined trajectory from launch to the impacting with a target for optimum warhead penetration of armor by a guided missile. Initially, the missile is guided in yaw by proportional navigation. Subsequently it is guided in pitch first by a pitch programmer until the missile reaches a predetermined gimbal angle between a line of sight of a seeker of the missile and a centerline of the missile, then in pitch by a pseudo-time-optimal closed loop controller to direct the missile pitch attitude at a predetermined rate toward a target until said missile reaches another predetermined gimbal angle, and finally by proportional navigation in pitch of the missile to the target.

6 Claims, 2 Drawing Figures

TRAJECTORY SHAPING OF ANTI-ARMOR MISSILES VIA TRI-MODE GUIDANCE

DEDICATORY CLAUSE

The invention described herein may be manufactured, used, and licensed by or for the Government for governmental purposes without the payment to us of any royalties thereon.

CROSS REFERENCES TO RELATED APPLICATION

This application is related to application Ser. Nos. 885,721, filed Mar. 13, 1978, by Alongi et al and 910,307 filed May 30, 1978, now U.S. Pat. No. 4,198,015 by Yates et al in that they are each concerned with guiding a missile along a predetermined trajectory to a target. These inventors are also co-inventors on the subject application.

BACKGROUND OF THE INVENTION

In the past, known terminal guidance missile systems, other than applicants' previously filed applications, Ser. Nos. 885,721 dated Mar. 13, 1978 and 910,307 dated May 30, 1978, now U.S. Pat. No. 4,198,015, have included proportional navigation with limited trajectory shaping resulting in either a flat approach trajectory which reduces warhead penetration, or from a lofted or ballistic type trajectory. Ballistic-like trajectories are often unable to perform well under low cloud cover conditions, often impacting in a misaligned high angle-of-attack fashion which also reduces warhead penetration. This problem was solved by the two above-mentioned applications by the use of trajectory shaping and a time-optimal controller. This solution, however, remained complex in operation and cost.

SUMMARY OF THE INVENTION

In accordance with this invention, a missile system is provided that includes the launching of a missile from ground or from a low-flying aircraft, a method for quickly climbing to and holding a preselected altitude, a method for diving sharply down towards a target, a proportional navigation guidance phase to the target and logical switching among the above modes of operation so as to obtain the desired end point conditions at impact.

Tri-mode guidance uses a pseudo-time-optimal closed loop pitch controller for trajectory shaping which can be easily incorporated into a missile with a minimal amount of hardware and yields optimum impact performance. Using tri-mode guidance a missile system trajectory may be held under local cloud cover, can be varied in size and shape, controls and guides the missile in a minimum time, is inexpensive and can be implemented and mechanized in the missile in a simple way, and impacts the target accurately, with a near-zero angle-of-attack alignment, and at an optimally high incoming trajectory impact angle. A pitch programmer is utilized which allows the missile to climb to and cruise at a predetermined altitude. The pseudo-time-optimal closed loop pitch controller, used during the dive phase, is turned on and then off by monitoring and comparing of a seeker gimbal angle. A final terminal homing phase allows the missile to use pitch proportional navigation to impact the target.

The missile has a seeker thereon that is locked onto a target at launch or shortly thereafter and in which the seeker feeds yaw rate signals in a proportional navigation to an autopilot which causes the missile to be guided in yaw. Also, as the missile is launched, a pitch programmed command guides the missile in pitch to a predetermined altitude and cruises until a predetermined angle between the missile body centerline and a seeker down looking line of sight is reached. Then a threshold detector detects this predetermined signal from a pitch gimbal angle channel of the seeker and causes the missile to dive by commanding a constant pitch rate which causes the missile to turn in minimum time to a desired attitude. After the missile has been turned to the desired relationship with the target, the threshold detector actuates a switch which switches out the last mode and activates a filtered pitch rate channel from the seeker to the autopilot. The missile is then guided in proportional navigation until target impact.

DESCRIPTION OF THE PREFERRED EMBODIMENT

Figure 1:
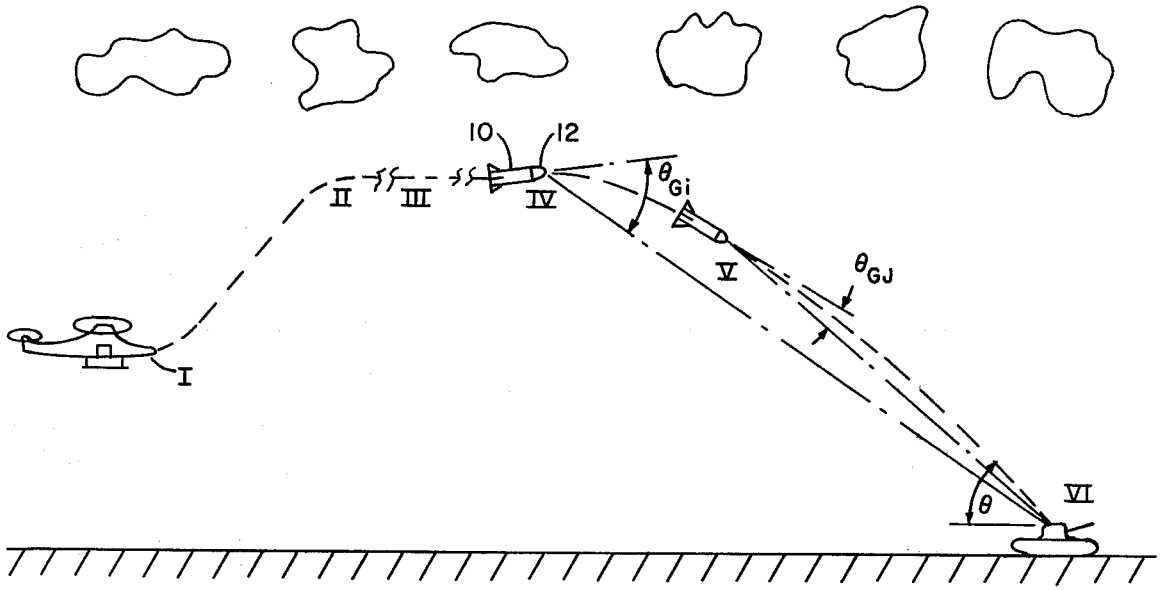
FIG. 1 illustrates a trajectory for a missile using the principle of the present invention.

Referring now to FIG. 1, a typical flight trajectory for a missile system utilizing the method of this invention is illustrated. Missile 10 has a terminal homing seeker 12 that is either a centroid tracker seeker such as a laser semi-active system or a contrast imaging seeker such as an infrared imaging seeker. Seeker 12 is used to acquire and lock onto the target. Missile 10 is launched with a nearly horizontal initial direction as shown at I. The launch may be from either low altitude aircraft or from a ground launcher. Missile 10 immediately climbs at a constant pitch up rate, then maintains its pitch attitude, using a zero pitch rate, then initiates a pitch down rate causing missile 10 to enter the cruise mode as indicated at II. Missile 10 then flies in the cruise mode, compensating for drag by maintaining a residual angle of attack, during that portion of the flight indicated by III, i.e., that period of flight after switchover to cruise and prior to the impact attitude transition phase initiated at IV. When the pitch gimbal angle, which is the angle between the missile seeker line of sight which is tracking the target, and the missile body centerline, reaches a predetermined value ($\theta_{Gi}$) at IV, a pseudo-time-optimal controller causes the missile to commence a near-time-optimum attitude transition turn to cause the angle between the seeker line of sight and the missile body centerline to approach zero. When this angle reaches the desired angle $\theta_{Gj}$, the turn is complete and the missile goes to proportional guidance at V and homes to target impact as indicated at VI.

The true missile pitch angle $\theta$ is measured from an inertially fixed coordinate frame, and is the physical tilt of the missile at any time. The two trigger angles, $\theta_{Gi}$ and $\theta_{Gj}$, are landmarks along the $\theta$ route at which something happens: During the cruise phase, when $\theta$ reaches the $\theta_{Gi}$ level, the dive phase is initiated. During the dive phase, when $\theta$ reaches the $\theta_{Gj}$ level, the terminal homing phase is initiated.

Figure 2:
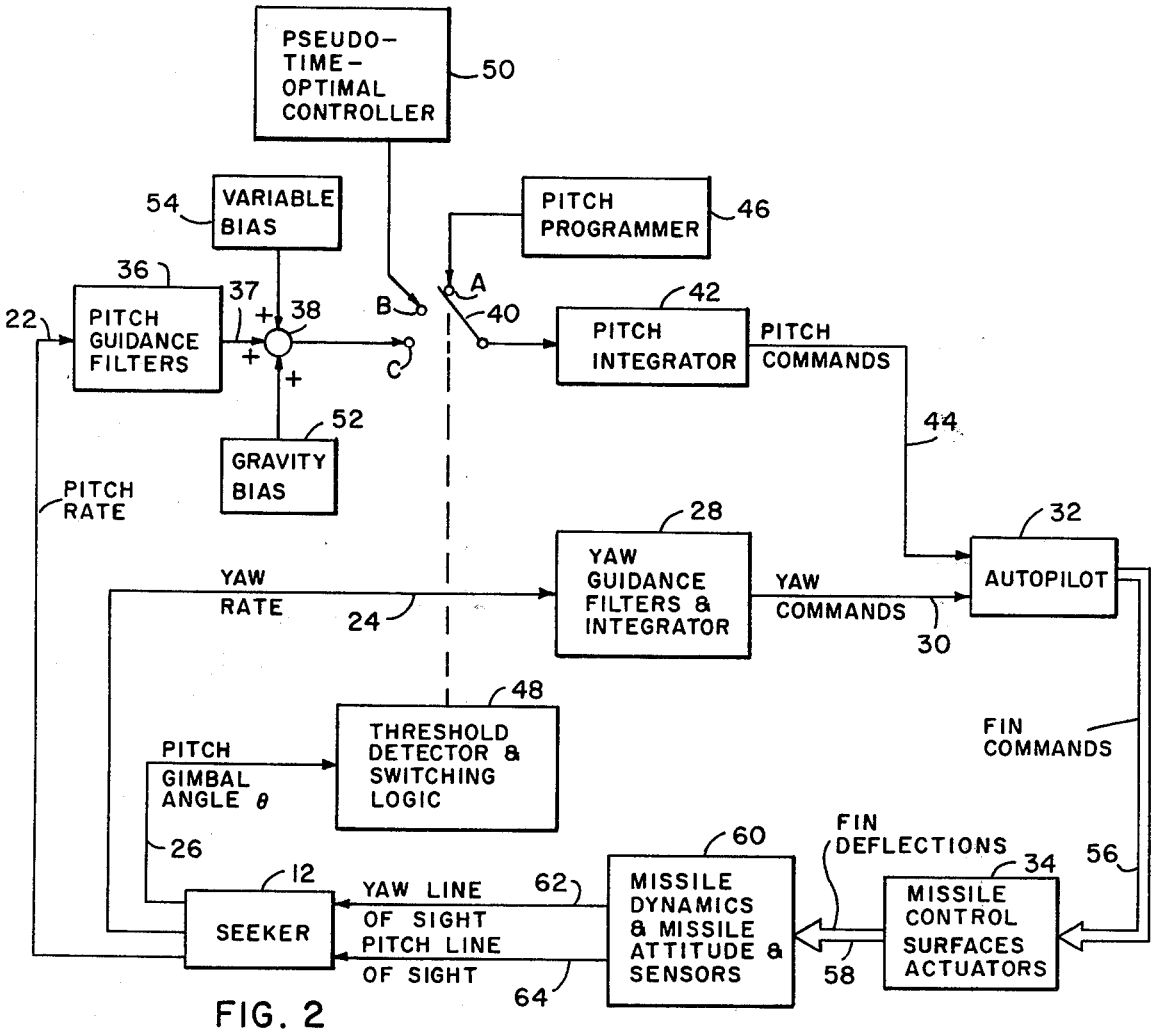
FIG. 2 is a block diagram of a preferred embodiment of the guidance system for achieving the predetermined trajectory of FIG. 1.

The guidance scheme for achieving the trajectory of FIG. 1 is illustrated in FIG. 2. Seeker 12 has at least three separate electrical outputs, including target-tomissile relative pitch rate 22, relative yaw rate 24, and relative pitch gimbal angle 26. Yaw rate channel 24 is connected through its filters and integrator 28, yielding yaw guidance commands 30, to the autopilot 32 for causing the missile to be guided in the yaw plane entirely by conventional proportional navigation upon target acquisition by commanding and controlling actuation of yaw control surface actuator by means of missile control surface actuators 34. Actuators 34 control pitch and yaw fin deflections 58. Missile position or attitude sensors 60 couple the actual attitude of the missile as pitch and yaw signals 64 and 62 to seeker 12 for combining with seeker target tracking signals.

Pitch rate channel 22 is connected to filters 36 which provide a filtered pitch rate output 37 through summer 38, and switch 40 only when switch 40 is in position C, and through integrator 42 to autopilot 32. The guidance filters of 36 and 28 may be implemented by a low-pass, electrical resistor-capacitor active network or by a numerical algorithm in a microprocessor, or by other similar means to provide the filtered output signal. Integrator 42 yields pitch guidance commands 44. Switch 40 at launch is in position A to connect pitch programmer 46 to autopilot 32 through integrator 42 for causing the missile 10 to be guided in pitch by a predetermined controlled actuation of pitch control surface actuator means of missile control surface actuators 34. Pitch programmer 46 is programmed and utilized for controlling missile 10 in pitch during the climb and cruise phase to point IV of FIG. 1.

Pitch gimbal angle channel 26 is directly connected to threshold detector and switching logic 48 after climb phase is complete. Pseudo-time-optimal controller 50 is connected to autopilot 32 through switch 40 when switch 40 is in position B, and through integrator 42. At point IV, threshold detector and switching logic 48 senses a predetermined gimbal angle $\theta_{Gi}$ between the missile body centerline and the seeker down looking line-of-sight to the target. This gimbal angle, $\theta_{Gi}$, is related to the desired impact attitude $\theta$ of FIG. 1. When predetermined angle $\theta_{Gi}$ is sensed, the threshold detector and switching logic 48 actuates switch 40 to position B to disconnect the pitch programmer 46 and connect the pseudo-time-optimal controller 50, initiating the dive phase. The pseudo-time-optimal controller 50 puts out a predetermined negative constant which applies a downward constant missile pitch rate, to cause missile 10 to pitch down sharply towards the target. With this type procedure the missile can be caused to turn more rapidly than with other arrangements, and approximately as fast as that using a pure fin time optimal controller as used by Yates, Leonard and Alongi as disclosed in application Ser. No. 910,307 filed May 30, 1978, now U.S. Pat. No. 4,198,015.

When another predetermined gimbal angle $\theta_{Gj}$ between the missile body centerline and the seeker line of sight to the target is reached, as determined by the threshold detector and switching logic 48, switch 40 is actuated by the detector to position C, at about position V of FIG. 1. Switch 40 then stays in position C until target impact. With switch 40 in position C, the missile flies to the target using proportional navigation in both pitch and yaw channels except in that the normally used gravity bias 52 is augmented by the addition of a variable bias 54 term. Bias term 54 may be a monotonically time varying signal such as a capacitive discharge through a resistance in order to decrease the angle of attack. That is, autopilot 32 is now receiving pitch commands 44 which consists of filtered, biased and integrated pitch rate signals through channel 22, and is also receiving yaw commands 30 which consists of filtered and integrated yaw rate signals through channel 24, to cause the missile to impact the target through proportional navigation guidance.

Pseudo-time-optimal controller 50 has a voltage output (in an analog system) or a number output (in a digital system) which corresponds to a pitch rate. This voltage or number does not change sign, but is slowly and monotonically time varying. It can be realized in several ways: by an electrical resistor-capacitor network, in which the initially (at launch) charged capacitor is very slowly discharging through the resistor, or by a software counter within a computer program of a microcomputer, or by other similarly established means. Its result is to induce in the missile a constant downward angular rate during the dive phase. Since the dive phase normally lasts for a fraction of a second, and a flight lasts for several seconds, the observed output of the controller 50 during its work at the dive phase appears substantially constant.

Pitch programmer 46 has an output which is a piecewise-constant train of pulses of voltage (in an analog system) or numbers (in a digital system), changing in magnitude and sign as a function of time. Initially, a constant positive output is produced for a short time period, inducing a constant pitch up rate on the missile. The magnitude of this first portion is dependent on the initial missile pitch attitude, the missile aerodynamic qualities, and the desired cruising altitude to be attained by the missile. Secondly, a zero output is produced for another short time period, permitting the missile to remain in a constant pitch up attitude. Thirdly, a constant negative output is produced for a short time period, inducing a constant pitch down rate on the missile. The magnitude of this third portion is dependent upon the missile aerodynamic qualities, and the desired cruising altitude to be attained. The output then remains zero throughout the rest of the flight. The time periods for the three portions are determined by the missile aerodynamic qualities. Programmer 46 can be realized in several ways: by a standard cam-type electro-mechanical battery operated timer, in which an electric motor turns a shaped or notched wheel, then microswitches mounted around the wheel are activated or deactivated by the shapes or notches, or by software timers and software comparators within the computer program of a microcomputer, or by other means. Its result is to produce the above mentioned pitch commands so as to place the missile in a relatively constant altitude in preparation for the dive phase.

The threshold detector and switching logic 48 has the necessary elements to remember $\theta_{Gi}$ and $\theta_{Gj}$, determine which phase is active, compare the instantaneous $\theta$ to $\theta_{Gi}$ and/or $\theta_{Gj}$, signal when the comparison proves true, choose the proper comparison depending on the current phase, and activate the switch 40. The switch 40 is initialized at position A and is always stepped from position A to position B to position C, such that it requires only two commands or nods from the logic 48. The logic 48 can be realized in several ways: one way is by the use of two Schmitt triggers, receiving $\theta$ from the seeker gyros, each designed to activate at either $\theta_{Gi}$ or $\theta_{Gj}$. Solid state switches, such as switching transistors, can be used to connect to one of the two Schmitts. A three or four state phase flag, made up of flip-flops, which identifies the particular mode of operation (climb, cruise, dive, etc.) can be fed to gated logic circuits to properly command the solid state switches. A set of solid state switches, or a mechanical stepping switch, can be used as switch 40, which is actuated by the switched output of the Schmitts. Another way is by the use of software logic and software comparators within the computer program of a microcomputer.

The yaw guidance filters and integrator 28 processes raw data from the sensor (seeker 12) into a yaw command 30 to the autopilot 32. The guidance filters and accumulator in yaw or pitch reduce noise inherent in the channel, and provide the proper frequency phasing necessary to yield a well performing automatic guidance controller system. These filters are usually represented in the frequency domain by low-pass lead-lag compensators, but their form depends highly on the overall missile characteristics. They can be realized by operational amplifier based filter networks, or by difference equation algorithms within the computer program of a microcomputer, or by other means.

The heart of this guidance scheme is the relative location of standard pitch integrator 42, its separation from the pitch guidance filters 36, and the insertion of the tri-mode switchings, biases, and mode controllers. Without the integrator 42, the controller 50 and the programmer 46 would be much more complex than the current simple almost-constant output form, the variable bias would be difficult to implement, and the terminal homing phase accuracy would drastically suffer. If the standard summer or adder 38 were missing, no biases would be possible thus deteriorating alignment and reducing armor penetration, and possibly reducing accuracy. The function of the pitch guidance filter 36, which has been previously discussed in terms of yaw, is to process raw sensor data into a more amenable form, usually that of a steering command.

In operation, terminal homing seeker 12 is locked onto the selected target prior to launch or the terminal homing seeker acquires the target during the cruise phase. In either case, missile 10 is launched with a nearly horizontal initial direction as shown at I. Pitch programmer 46 is initiated at launch causing the missile to enter the cruise mode as indicated at II for control of the missile in the pitch plane from launch through cruise III to attitude transition phase IV. During this time, the missile is guided in the yaw plane by conventional proportional navigation after target acquisition whether this occurs prior to or subsequent to launch. If the missile is launched without target acquisition, the yaw channel is controlled to zero deviation from the launch trajectory until acquisition occurs then guidance reverts to proportional navigation. During the cruise phase and after target tracking has occurred, threshold detector 48 monitors the angle between the missile body centerline and seeker 12 down looking line-of-sight to the target in the pitch plane. When this angle $\theta_{Gi}$ exceeds a predetermined value (normally 70 to 90% of the desired impact attitude) the threshold detector causes switch 40 to move to position B, disengaging programmer 46 and activating controller 50. The controller then applies full control surface movement through switch 40 and missile control surface actuators 34 to cause the missile to pitch down toward the target. When the gimbal angle value $\theta_{Gj}$ is sensed via channel 26 to detector circuit 48, the missile pointing at the target is at about position V. Switch 40 is caused to go to position C. From this point, the missile then flies to the target using proportional navigation in both pitch and yaw channels. That is, autopilot 32 is now receiving pitch rate signals through channel 22 and yaw rate signals through channel 24 to cause the missile to be guided in proportional navigation.

Although a particular embodiment and form of the invention has been described, it will be obvious to those skilled in the art that modifications may be made without departing from the scope and spirit of the invention. Accordingly, it is understood that the invention is limited only by the claims appended hereto.

We claim:

1. A missile guidance system for guiding a missile in a predetermined trajectory to impact with a target, said trajectory including initial climb, cruise, and attitude transition portions, said guidance system comprising: a seeker carried by said missile for tracking said target; an autopilot, said seeker having a yaw rate channel output coupled to said autopilot for controlling flight of the missile by proportional navigation in the yaw plane; a pitch programmer coupled to said autopilot for controlling flight of the missile in the pitch plane during said climb and cruise portions; a pseudo-time-optimal controller coupled to said autopilot for sharply diving said missile towards the target; and means for controlling the missile in pitch during said attitude transition portion including, threshold detector and switching logic means coupld for receiving pitch gimbal angle signals from said seeker for causing said pseudo-time-optimal controller to apply a constant angular rate to the missile to cause the missile to pitch down sharply towards the target under control of said pseudo-time-optimal controller.

2. A missile guidance system as set forth in claim 1 wherein said seeker has a pitch rate output adapted for coupling to said autopilot for controlling flight of the missile by proportional navigation in the pitch plane during attitude transition portions of terminal trajectory.

3. A missile guidance system as set forth in claim 2 and further comprising switching means having first, second, and third switching positions, a pitch integrator coupled between said autopilot and said switching means, said pitch programmer being coupled through a first position of said switching means to said pitch integrator for coupling signals therefrom to said autopilot when said switch is in the first position, said pseudo-time-optimal controller being coupled to said second position of said switching means for coupling signals through said integrator to said autopilot when said switch is in a second switch position, and said seeker pitch rate output being coupled to said third position of said switching means for coupling signals through said integrator to said autopilot when the switch is in the third position.

4. A missile guidance system as set forth in claim 3 wherein said threshold detector and switching logic means is adapted to selectively activate said switch means to disconnect said pitch programmer from said autopilot and to connect said pseudo-time-optimal controller to said missile autopilot, and subsequently to disconnect said controller from said autopilot and connect said seeker pitch rate output thereto when said attitude transition portion is complete to adapt said autopilot for guiding said missile in proportional navigation in both pitch and yaw to target impact.

5. A missile guidance system as set forth in claim 4 and further comprising filtering and integrating means coupled between said seeker yaw rate output and said auto pilot input, and filter means coupled between said seeker pitch rate output and said third switching position.

6. A missile system as set forth in claim 1 wherein said seeker is selected from the group consisting of a laser semi-active seeker and an infrared imaging seeker.

* * * * *